US009643693B2

(12) United States Patent
Kim et al.

(10) Patent No.: US 9,643,693 B2
(45) Date of Patent: May 9, 2017

(54) FLOATING MARINE STRUCTURE HAVING FLOATS

(71) Applicant: Korea Institute of Ocean Science & Technology, Gyeonggi-do (KR)

(72) Inventors: Hyeon Ju Kim, Gangwon-do (KR); Sa Young Hong, Daejeon (KR); Dong Ho Jung, Daejeon (KR); Bo Woo Nam, Daejeon (KR); Yong Ju Kwon, Daejeon (KR)

(73) Assignee: KOREA INSTITUTE OF OCEAN SCIENCE & TECHNOLOGY, Gyeonggi-Do (KR)

( * ) Notice: Subject to any disclaimer, the term of this patent is extended or adjusted under 35 U.S.C. 154(b) by 0 days.

(21) Appl. No.: 14/900,808

(22) PCT Filed: Mar. 12, 2015

(86) PCT No.: PCT/KR2015/002387
§ 371 (c)(1),
(2) Date: Dec. 22, 2015

(87) PCT Pub. No.: WO2016/122047
PCT Pub. Date: Aug. 4, 2016

(65) Prior Publication Data

US 2016/0368576 A1 Dec. 22, 2016

(30) Foreign Application Priority Data

Jan. 29, 2015 (KR) ..... 10-2015-0014466

(51) Int. Cl.
*B63B 35/44* (2006.01)
*B63B 39/00* (2006.01)

(52) U.S. Cl.
CPC ..... *B63B 35/44* (2013.01); *B63B 39/00* (2013.01)

(58) Field of Classification Search
IPC ..... B63B 35/44
See application file for complete search history.

(56) References Cited

U.S. PATENT DOCUMENTS 4,174,185 A * 11/1979 Toki ..... E02B 15/08 405/212

FOREIGN PATENT DOCUMENTS

| | | | |
|---|---|---|---|
| KR | 1998-244989 | A | 9/1998 |
| KR | 2009-184671 | | 8/2009 |
| KR | 10-2011-0024681 | A | 9/2009 |

(Continued)

*Primary Examiner* — Stephen Avila
(74) *Attorney, Agent, or Firm* — Dentons US LLP

(57) ABSTRACT

A floating marine structure which includes a first float disposed at the center and a plurality of second floats disposed around the first float, where the first float has a floating body made of a floatable material in a polygonal prism shape, a damping unit coupled to the bottom of the floating body at the center, having the same cross-section as the floating body, having a cross-sectional area larger than the cross-sectional area of the floating body, and reducing a shake of the first float in the sea, and at least one coupling hole formed at each side of the floating body. The second float has the same shape as the floating body and has coupling protrusions formed at sides facing the sides of the floating body and inserted in the coupling holes, and wherein the coupling holes are formed at alternate sides of the floating body.

7 Claims, 23 Drawing Sheets

(56) References Cited

FOREIGN PATENT DOCUMENTS

| | | | |
|---|---|---|---|
| KR | 10-2010-0071237 | A | 6/2010 |
| KR | 10-2011-0016684 | A | 2/2011 |
| KR | 10-2011-0121099 | A | 11/2011 |
| KR | 10-2012-0041814 | A | 5/2012 |
| KR | 10-2013-0131121 | A | 12/2013 |
| KR | 10-2014-0090753 | A | 7/2014 |

* cited by examiner

FLOATING MARINE STRUCTURE HAVING FLOATS

CROSS-REFERENCE TO RELATED APPLICATION

This application is the Section 371 National Stage of PCT/KR2015/002387 filed Mar. 12, 2015, the entirety of which is incorporated herein by reference to the extent permitted by law. This application claims the benefit of priority to Korean Patent Application No. KR 10-2015-0014466, filed Jan. 29, 2015 the entirety of which is incorporated herein by reference to the extent permitted by law.

FIELD OF THE DISCLOSURE

The present invention relates to a marine structure having floats and, more particularly, a marine structure formed by connecting a plurality of floats around a float equipped with a damping unit that can reduce heaving, pitching, rolling, and yawing of a float on the sea due to waves and surges.

BACKGROUND

In general, thermal power generation using fossil fuel and atomic power generation using nuclear fission can be considered as typical types of power generation.

However, the thermal power generation has a problem that it causes environmental pollution because it uses energy produced by burning fossil fuel and it requires a large amount of construction costs. The atomic power generation is advantageous in producing a large amount of power, but it also requires a large amount of costs for facilities for preventing leakage of radiation. Further, an atomic power plant is considered as a dangerous facility, so it is necessarily accompanied by strong opposition by residents even from the step of preparing construction. In addition, waste treatment is difficult and even a small accident always has possibility of severe ecocide.

Accordingly, as an alternative to thermal power or atomic power natural energy sources such as wind force, tidal power, water power, and solar heat, which do not cause environmental pollution, have attracted attention as not only as clean energy sources, but also as a permanent and inexhaustible energy sources.

However, water power generation, a typical type of natural power generation, does not cause environmental pollution, but requires great cost when a dam is built for blocking water. Further, when a dam is constructed, it is accompanied by changes in the ecosystem due to wide areas being submerged, and if the ecosystem changes are severe, they may even cause a secondary environmental problem of changing the climate of the area. Further, wind power generation and solar power generation are influenced by weather conditions, so it is impossible to generate power when there is no wind or when solar radiation energy is blocked.

On the other hand, there is OTEC (Ocean Thermal Energy Conversion), which is another type of power generation using clean energy.

OTEC, which employs a power generation system using heat of vaporization and heat of condensation from surface water at a high temperature and deep water at a low temperature, does not produce carbon because it takes energy only from the seawater, and the seawater can be used as an infinite recyclable energy source.

Marine facilities that can generate power on the sea are necessary for OTEC and those marine facilities can be floated on the sea by floats with a predetermined area ensured.

A technique relating to installation of marine facilities has been disclosed in Korean Patent Application Publication No. 10-2013-0131121. Korean Patent Application Publication No. 10-2013-0131121 proposes a 'Floating production storage and offloading', which includes a lower floating structure having a predetermined space and at least one column disposed on the lower floating structure, with a lower portion inside the lower floating structure.

However, such a floating structure may be moved in a heaving, pitching, rolling, or yawing fashion by waves or surges. Such movement of the floating structure may have an adverse influence on control and operation of the marine facilities on the float.

Further, when an artificial island is constructed on the sea or there is a need for a large scale marine facility, there is a limit in increasing the size of a floating structure and it is also difficult to construct a floating structure because floating structures are generally complicated.

SUMMARY

The present invention has been proposed to solve the problems in the related art. According to an aspect of the present invention, there is provided a floating marine structure having floats that can be easily constructed by forming a coupling grove on a side of a first float and coupling an adjacent second float with a fastener that is inserted and fixed in the coupling groove.

According to another aspect of the present invention, there is provided a floating marine structure having floats that can reduce movement due to waves or surges by mounting a damping unit for reducing movement of a first float at the center of the floating marine structure.

However, the objects of the present invention are not limited to those stated above and other objects not stated above may be clear to those skilled in the art from the following description.

In order to achieve the above object, according to one aspect of the present invention, there is provided a floating marine structure having floats that includes: a first float disposed at the center; and a plurality of second floats disposed around the first float; in which the first float has: a floating body made of a floatable material in a polygonal prism shape; a damping unit coupled to the bottom of the floating body at the center, having the same cross-section shape as the floating body, having a cross-sectional area larger than the cross-sectional area of the floating body, and reducing movement of the first float in the sea; and at least one coupling hole formed at each side of the floating body; and the second float has the same shape as the floating body and has coupling protrusions formed at sides facing the sides of the floating body and inserted in the coupling holes, and in which the coupling holes are formed at alternate sides of the floating body.

The coupling hole may have an inlet hole formed inwardly perpendicular to the side of the floating body and a locking hole extending at a right angle from an end of the inlet hole, the coupling protrusion may have a first locking portion protruding outward from the side of the second float and a second locking portion extending at a right angle from an end of the first locking portion, and the second locking portion may be inserted in the inlet hole and then slid into the locking hole, thereby coupling the first float and the second float to each other.

First through-holes may be formed from a top of the floating body to the locking holes, second through-holes may be formed in the second locking portions, and the first float and the second float may be coupled to each other by inserting coupling pins into the first through-holes and the second through-holes with the second locking portions fitted in the locking holes.

The floating marine structure may further include covers disposed in spaces between adjacent second floats.

The floating body may have a regular octagonal cross-section.

The height ratio between the floating body and the damping unit may be 1.5:1 to 1.6:1.

The length ratio between the cross-section of the floating body and the cross-section of the damping unit may be 1:1.5 to 1:1.6.

According to another aspect of the present invention, there is provided a floating marine structure assembly formed by coupling a plurality of the floating marine structures of any one of claims 1 to 7.

According to the floating marine structure of the present invention, coupling holes are formed at the sides of the floating body of a first float and second floats are coupled to the first float with regular intervals by coupling protrusions that are inserted and fixed in the coupling holes, so the floats can be easily coupled.

Further, a damping unit for reducing movement is coupled to the first float at the center of the floating marine structure, so movement due to waves or surges can be reduced.

DETAILED DESCRIPTION

Exemplary embodiments of the present invention will be described more fully hereinafter with reference to the accompanying drawings. In the following description of the present invention, detailed descriptions of known functions and components incorporated herein will be omitted when it may make the subject matter of the present invention unclear.

Reference will now be made in detail to various embodiments of the present invention, specific examples of which are illustrated in the accompanying drawings and described below, since the embodiments of the present invention can be variously modified in many different forms. While the present invention will be described in conjunction with exemplary embodiments thereof, it is to be understood that the present description is not intended to limit the present invention to those exemplary embodiments. On the contrary, the present invention is intended to cover not only the exemplary embodiments, but also various alternatives, modifications, equivalents and other embodiments that may be included within the spirit and scope of the present invention as defined by the appended claims.

It will be understood that when an element is referred to as being "coupled" or "connected" to another element, it can be directly coupled or connected to the other element or intervening elements may be present therebetween. In contrast, it should be understood that when an element is referred to as being "directly coupled" or "directly connected" to another element, there are no intervening elements present. Other expressions that explain the relationship between elements, such as "between" "directly between" "adjacent to" or "directly adjacent to" should be construed in the same way.

The terminology used herein is for the purpose of describing particular embodiments only and is not intended to be limiting. As used herein, the singular forms "a" "an" and "the" are intended to include the plural forms as well, unless the context clearly indicates otherwise. It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

Figure 1:
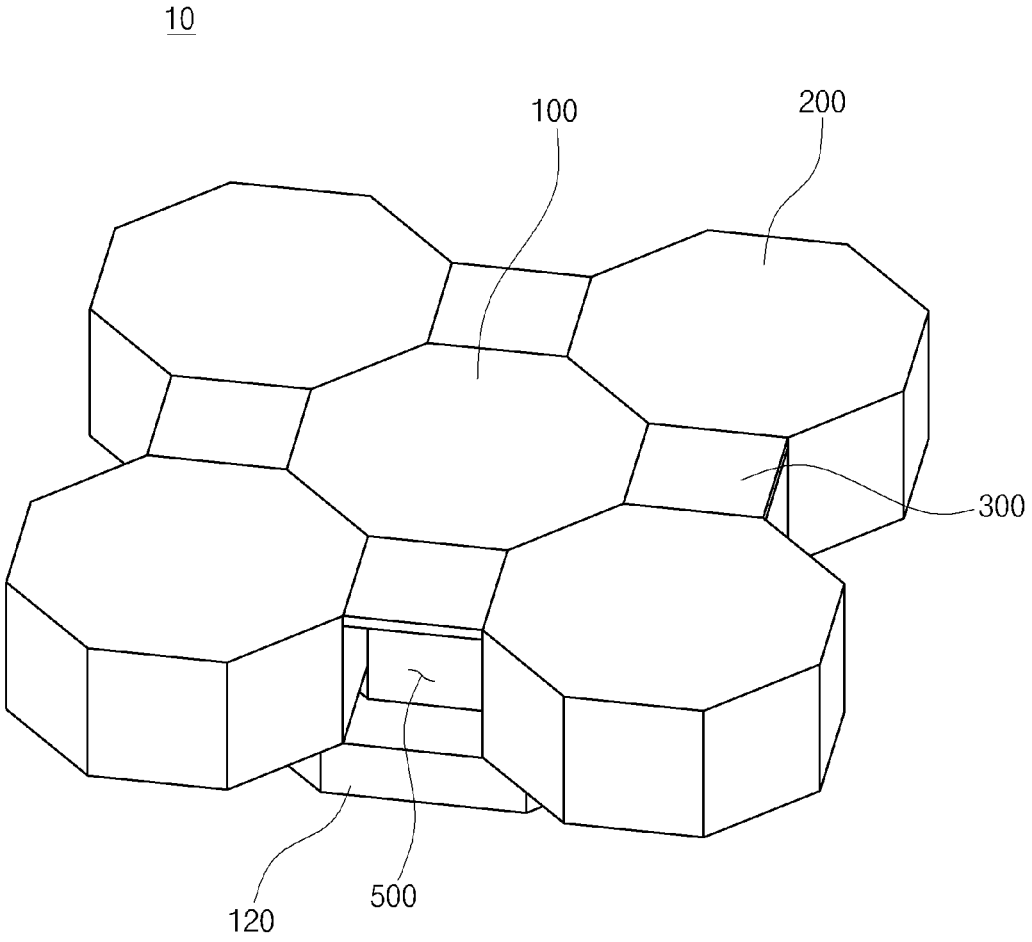
FIG. 1 is a perspective view schematically showing a floating marine structure having floats according to an embodiment of the present invention.

FIG. 1 is a perspective view schematically showing a floating marine structure having floats according to the present invention and FIGS. 2, and 3A to 3D are views showing a first float and a second float included in a floating marine structure according to the present invention.

Referring to FIGS. 1 to 3D, a floating marine structure 10 that is installed on the sea 1 according to the present invention may include a first float 100, a second float 200, and a cover 300.

The first float 100 is made of a floatable material and disposed at the center of the floating marine structure 10, and, as shown in the figures, may be composed of a floating body 110 and a damping unit 120. The configuration of the first float 100 will be described in detail below.

The second float 200 is made of the same material as the first float 100 and, a shown in the figures, may have the same shape as the floating body 110 of the first float 100.

The first float 100 and the second float 200 that are floated on the sea 1 can be coupled to each other by coupling holes 130 and coupling protrusions 210.

Figure 2:
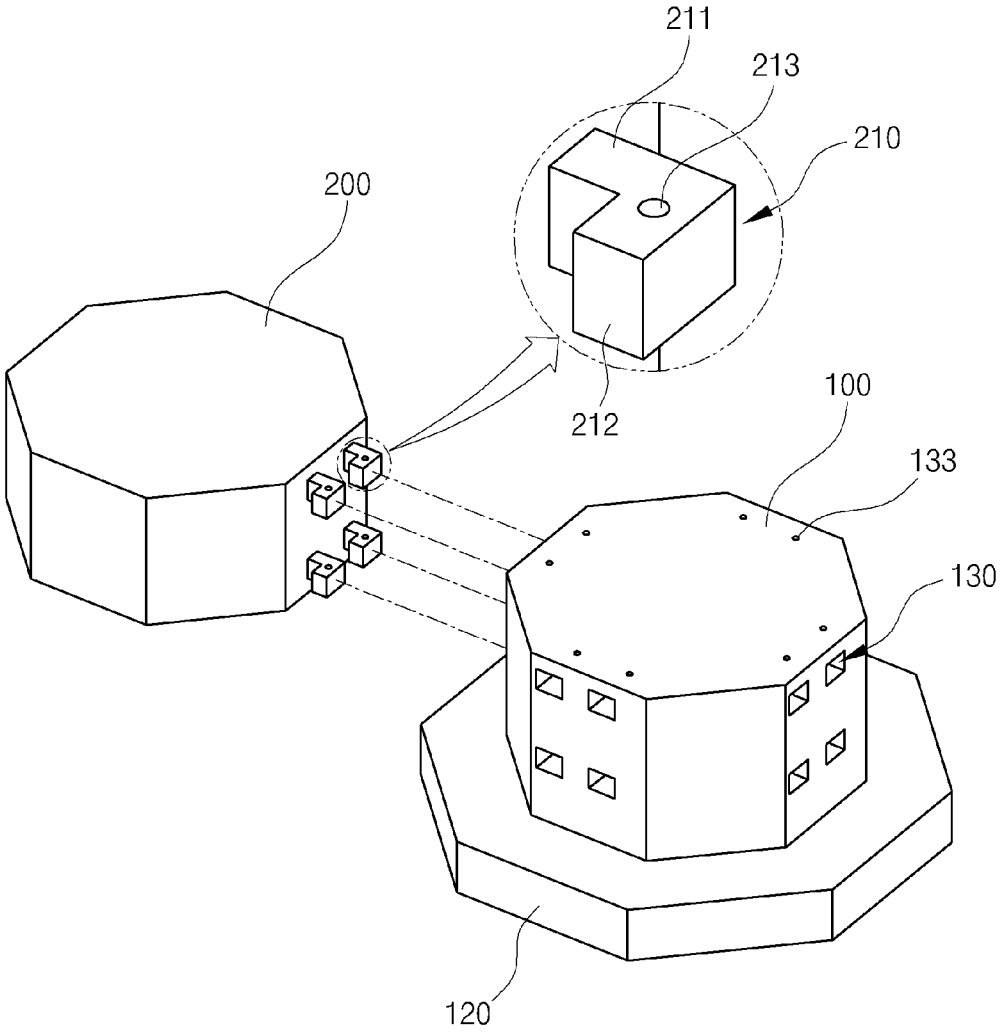
FIGS. 2, and 3A to 3D are view showing a first float and a second float included in a floating marine structure according to an embodiment of the present invention.
Figure 3A:
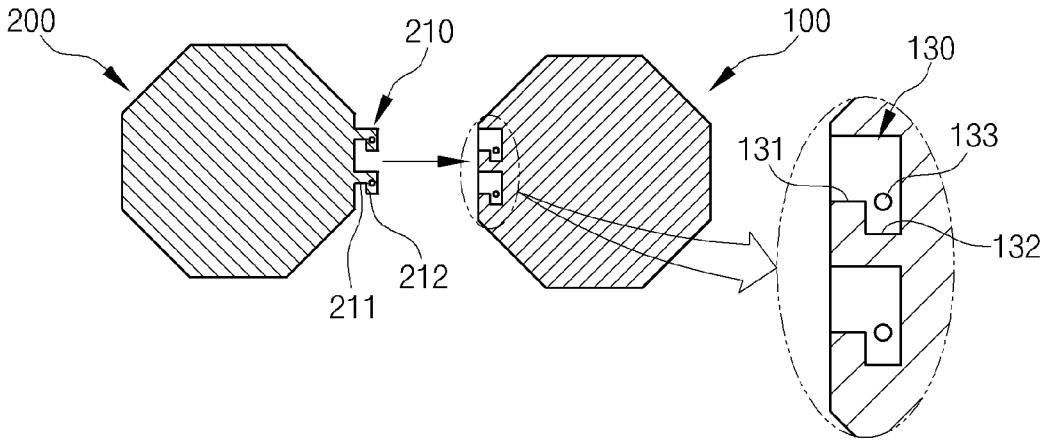
Figure 3B:
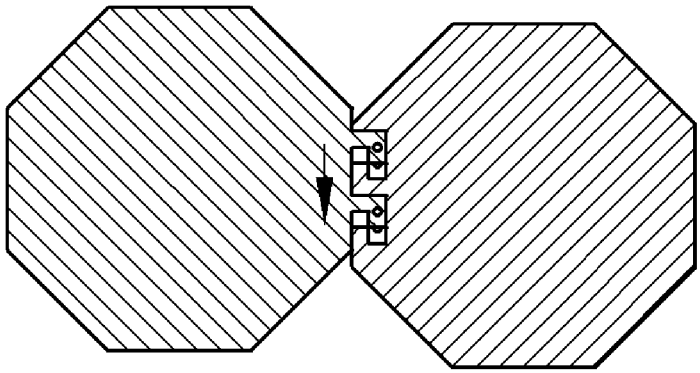
Figure 3C:
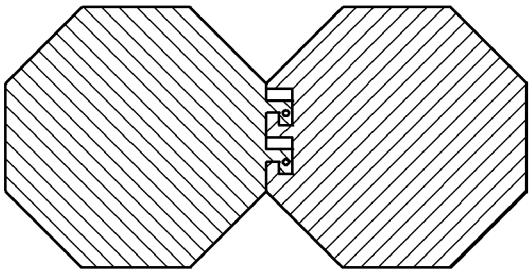
Figure 3D:
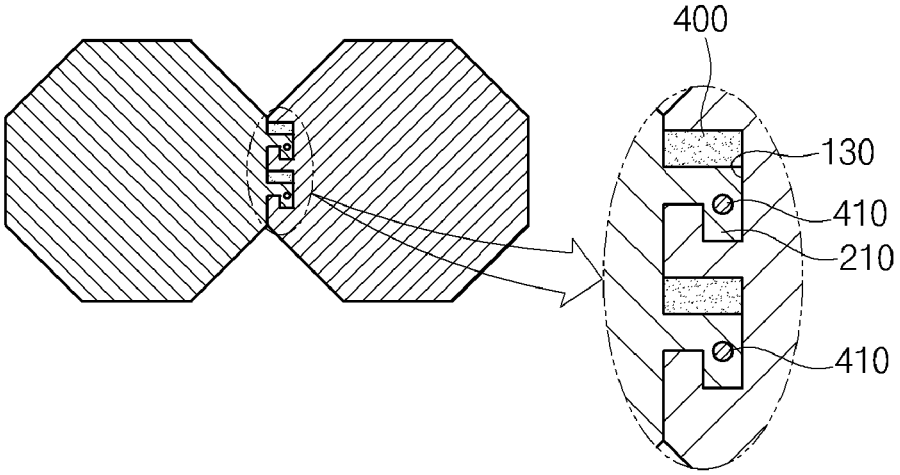

As shown in FIGS. 2 to 3D, a plurality of coupling holes 130 may be formed in the first float 100. In detail, the coupling holes 130 are formed on alternate sides of the floating body 110, that is, when the floating body 110 is a regular octagon, the coupling holes 130 may be formed at upper and lower sides and left and right sides of the floating body 110 when seen from above.

As shown in the figures, the coupling hole 130 may be composed of an inlet hole 131 formed inwardly perpendicular to the side and a locking hole 132 extending at the right angle from the end of the inlet hole 131.

The coupling protrusions 210 may be formed on the sides of the second float 200, which face the sides of the floating body 110 where the coupling holes 130 are formed. The coupling protrusion 210 may have a first locking portion 211 protruding outward from the side of the second float and a second locking portion 212 extending at the right angle from the end of the first locking portion 211.

Accordingly, referring to FIGS. 3A to 3D, the second locking portion 212 is inserted in the inlet hole 131 of the floating body 110 and then slid in the direction of an arrow, as shown in FIG. 3B, so the second locking portion 212 can be fitted in the locking hole 132, as shown in FIG. 3D.

Thereafter, though not shown in detail, the first float 100 and the second float 200 can be more firmly fixed by injecting cement 400 into the coupling hole 130 through grouting etc.

First through-holes 133 may be formed vertically from the top of the floating body 110 (at positions corresponding to the positions of the coupling holes) to the locking holes 132 and second through-holes 213 may also be formed in the second locking portions 212.

Accordingly, a coupling pin 410 may be inserted, with the second locking portion 212 fitted in the locking hole 132 and the first through-hole 133 and the second through-hole 213 aligned. Accordingly, the locking protrusion 210 cannot be separated out of the coupling hole 130.

When the second floats 200 are coupled to the first float 100, as shown in FIG. 1, second floats 200 may be disposed at alternate sides of the floating body 110 of the first float 100. Accordingly, a plurality of covers 300 can be disposed in the spaces between adjacent second floats 200.

Figure 4:
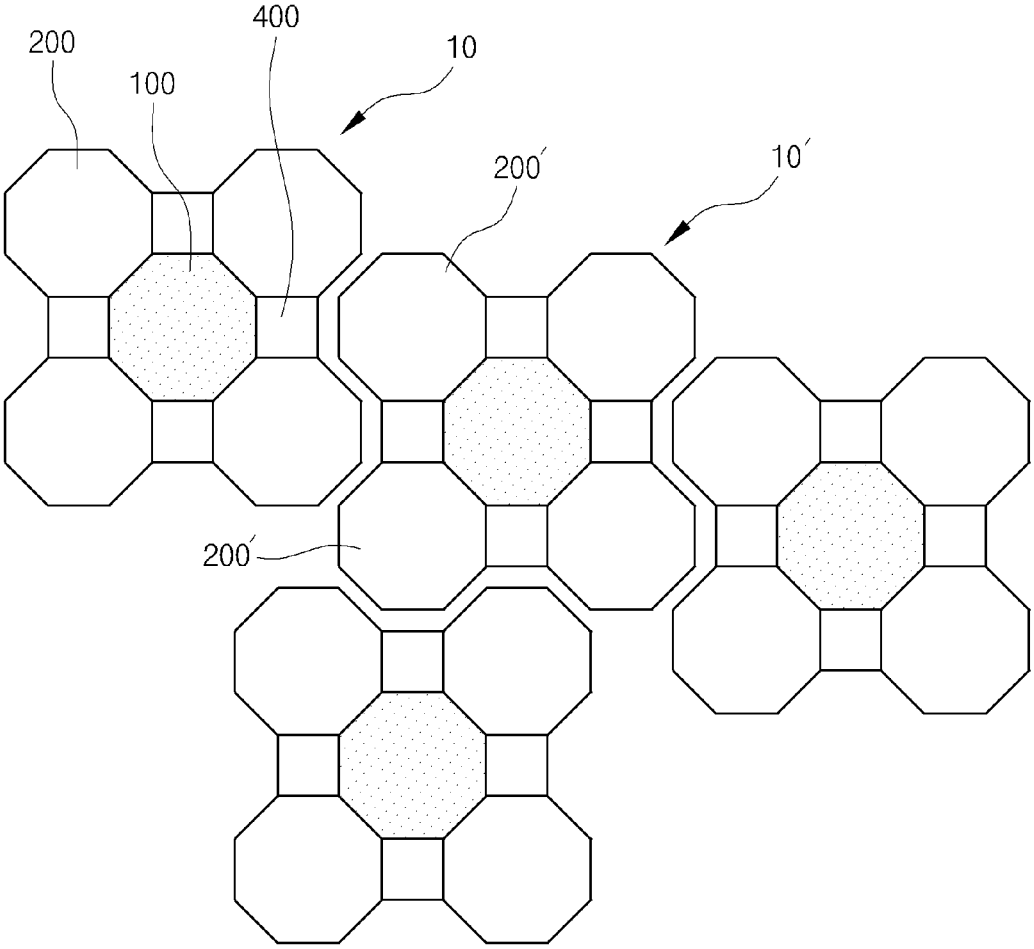
FIG. 4 is an exemplary view showing a floating marine structure assembly formed by coupling a plurality of floating marine structures each of which is achieved by coupling a plurality of floats according to an embodiment of the present invention.

The spaces between the first float 100 and the second floats 200 can be covered with the covers 300, and as shown in FIG. 4, when a plurality of floating marine structures 10 are connected, air shock-absorbing spaces 500 can be formed on the sea by covering these spaces.

For example, when a regular octagonal first float 100 and second floats 200 are coupled, a square space can be defined, and when a plurality of first floats 100 and second floats 200 are coupled and floated on the sea, the air shock-absorbing spaces 500 filled with air are achieved between the surface of the sea and the cover by covering the spaces with the covers 300, so shock-absorbing effect such as damping can be achieved.

Movement of the floating marine structure 10 due to waves and surges can be reduced by the air shock-absorbing spaces 500 and the air shock-absorbing spaces 500 can be used for raising fish and domestic animals, leisure, and other desired purposes, and for OWC wave power generation through adjustment of compartments and pressure.

FIG. 4 is an exemplary view showing a floating marine structure achieved by coupling a plurality of floats according to the present invention.

As shown in FIG. 4, a floating marine structure assembly 20 can be achieved by coupling a plurality of floating marine structures 10 composed of a first float 100 and a plurality of second floats 200.

The floating marine structure assembly 20 can be achieved by coupling the second floats 200 of a floating marine structure 10 and the second floats 200' of another floating marine structure 10' to each other.

The second float 200 and the second float 200' may be coupled in the same way of coupling the first float 100 and the second float 200 or in other various ways, for example, using specific couplers.

Figure 5:
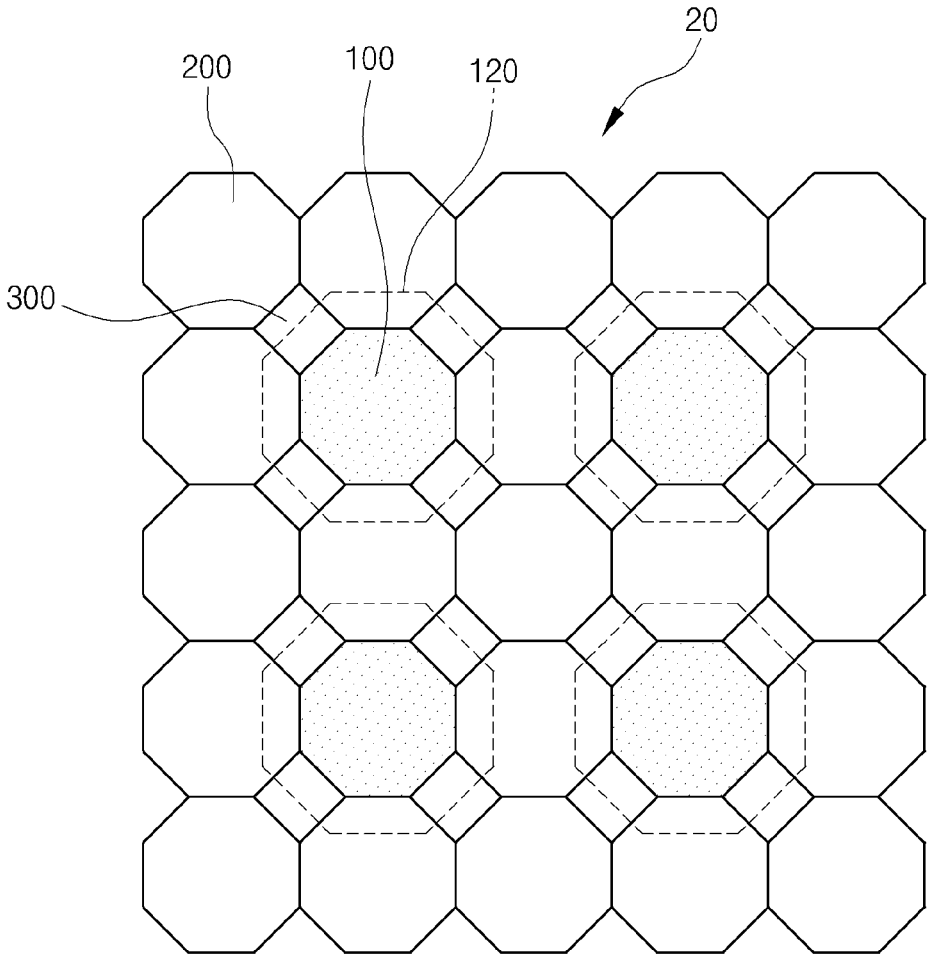
FIG. 5 is an exemplary view showing a floating marine structure assembly formed by coupling a plurality of floating marine structures each of which is achieved by coupling a plurality of floats in another away according to an embodiment of the present invention.
Figure 6:
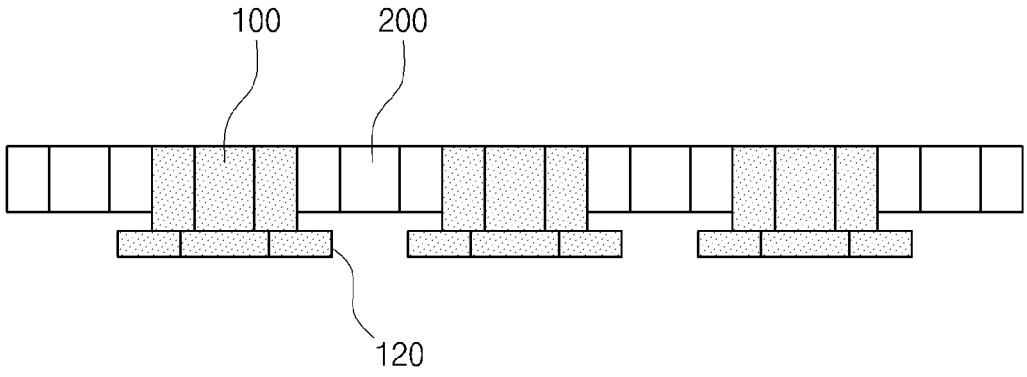
FIG. 6 is a cross-sectional view of the floating marine structure assembly shown in FIG. 5.

FIGS. 5 and 6 are exemplary views showing a floating marine structure assembly formed by coupling a plurality of floating marine structures each of which is achieved by coupling a plurality of floats in another away according to the present invention.

Referring to the figures, a floating marine structure assembly 20' can be formed by continuously coupling first floats 100 and second floats 200.

In this case, the first floats 100 and the second floats 200 are coupled by coupling holes 130 and coupling protrusions 210 without specific couplers, so the floating marine structure assembly 20' can be achieved in the same way of making the floating marine structure 10.

Figure 7:
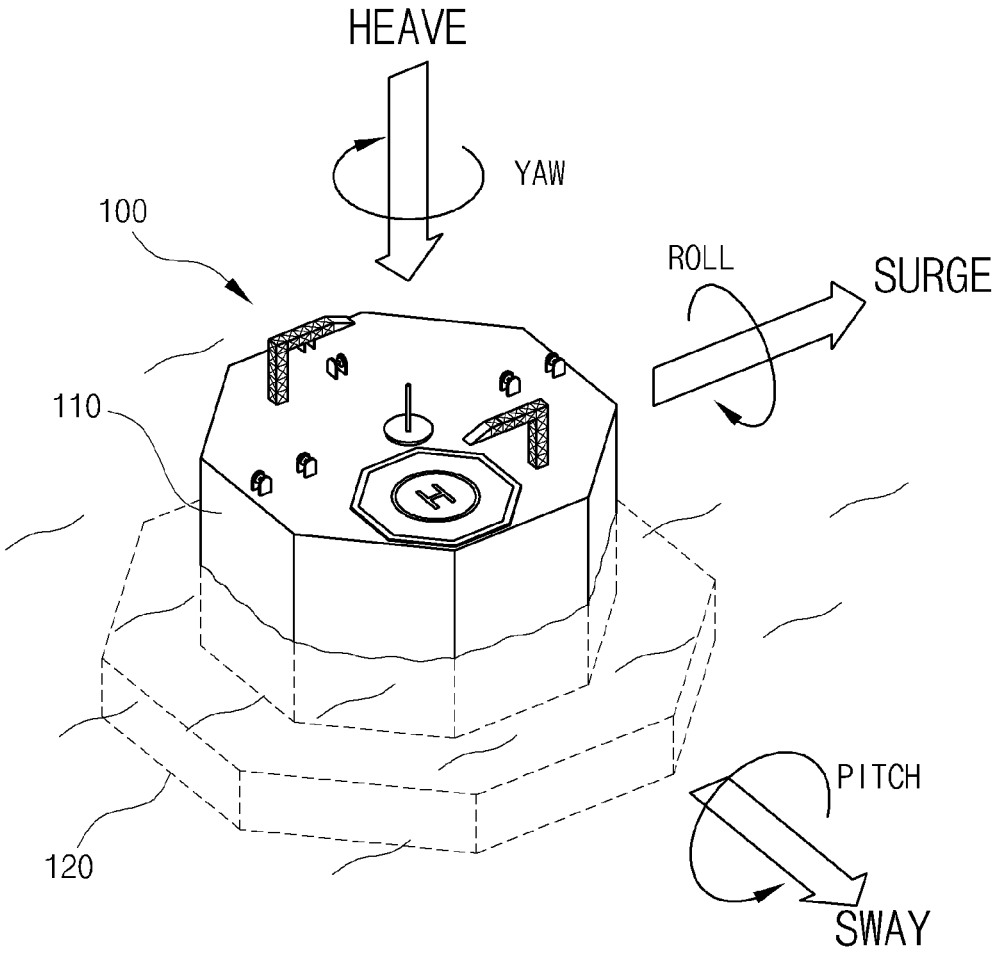
FIG. 7 is a perspective view schematically showing a first float of a floating marine structure according to an embodiment of the present invention.
Figure 8A:
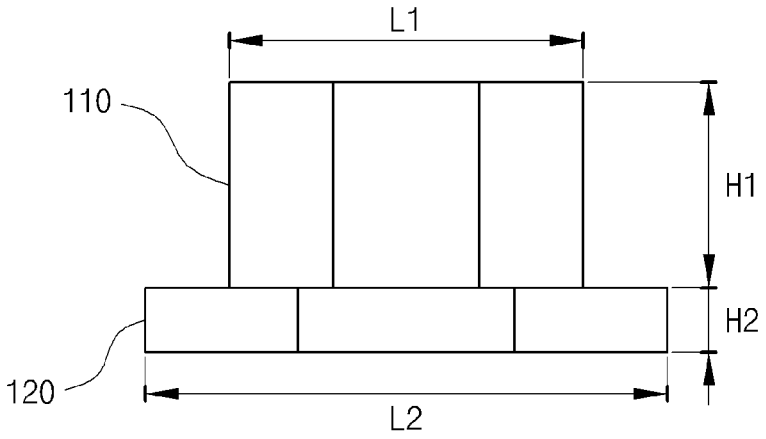
FIGS. 8A and 8B are a side view and a plan view of a first float according to an embodiment of the present invention.
Figure 8B:
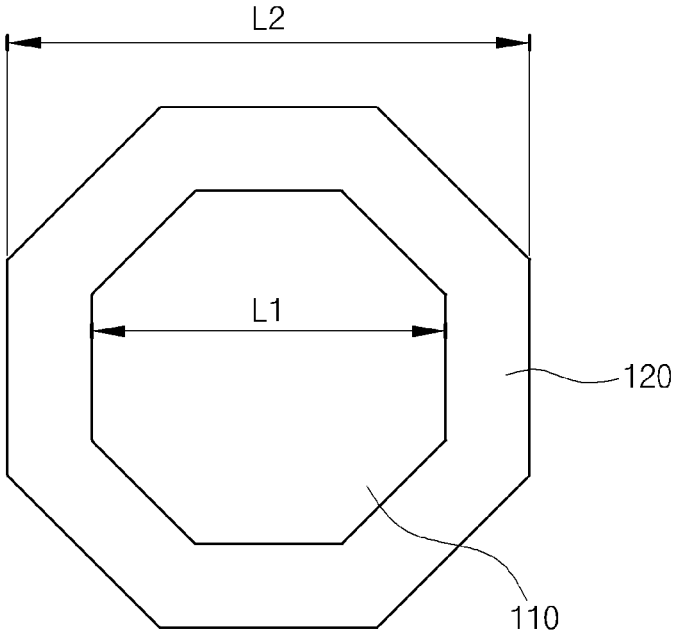

FIG. 7 is a perspective view schematically showing a first float of a floating marine structure according to the present invention and FIGS. 8A and 8B are a side view and a plan view of a first float according to the present invention.

Referring to the figures, a first float 100 according to the present invention, though not shown in detail, may be made of a floatable material and may be composed of a floating body 110 and a damping unit 120.

The floating body 110 is formed in the shape of a polygonal prism, and especially, the cross-section may be a regular polygon, for example, a regular octagon. The cross-section of the floating body 110 may formed in various shapes such as a regular hexagon, other than the regular octagon.

The floating body 100 has a space 111 therein and marine facilities 10 may be disposed in the space 111. The marine facilities 10 may be disposed on the top 112 of the floating body 110.

Further, though not shown in detail, it is possible to fix the position of the first float 100 on the sea by forming hooks on the sides of the floating body 110 and connecting to the bottom of the sea through a rope, a chain, or a wire.

The damping unit 120 may be disposed on the bottom of the floating body 110. In detail, the damping unit 120 may be disposed on the bottom of the floating body 110 with the centers aligned, so the damping unit 120 coupled to the floating body 110 may be disposed under the sea.

The damping unit 120 is a polygonal prism, the cross-sectional shape of the damping unit 120 may be the same as that of the floating body 110, and the cross-sectional area of the damping unit 120 may be larger than that of the floating body 110.

The height of the damping unit 120 may be smaller than that of the floating body 110.

As shown in FIGS. 8A and 8B, the ratio of the height H1 of the floating body 110 and the height H2 of the damping unit 120 may be 1.5:1 to 1.6:1, preferably, 1.58:1.

The ratio of the length L1 of the cross-section of the floating body 110 and the length L2 of the damping unit 120 may be 1:1.5 to 1:1.6.

Figure 9:
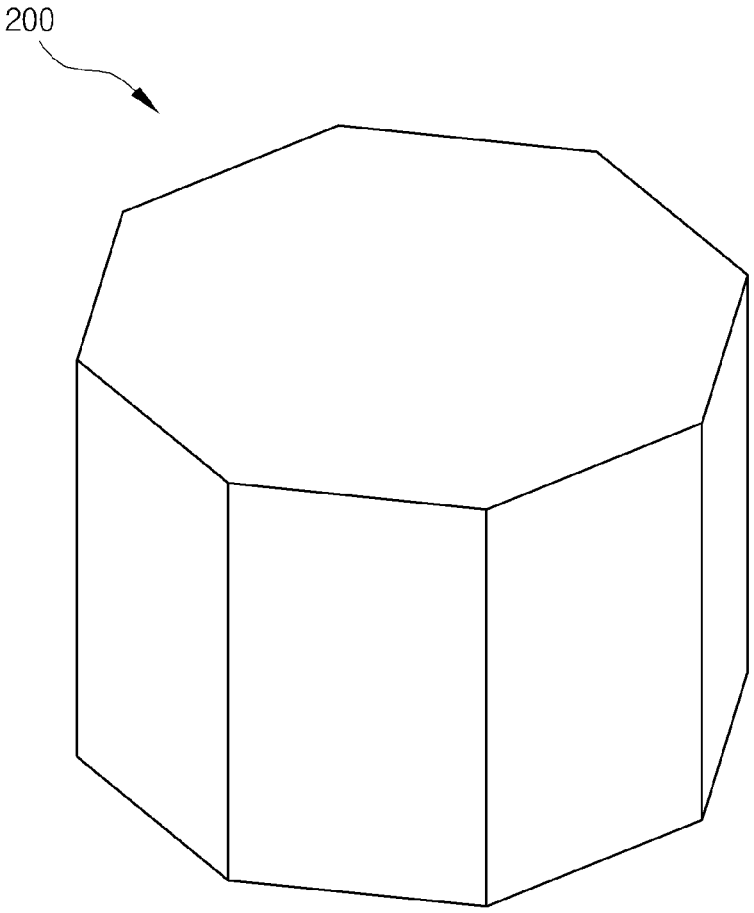
FIG. 9 is a perspective view schematically showing the configuration of a second float to compare characteristics with a first float according to an embodiment of the invention.

FIG. 9 is a perspective view schematically showing the configuration of a second float to compare characteristics with a first float, in which the second float 200 may be a polygonal prism with a regular octagonal cross-section.

In detail, the heights of the first float 100 and the second float 200 may be the same and the cross-sectional areas of the second float 200 and the floating body 110 may be the same.

FIGS. 10A to 11C are graphs showing motion response characteristics to irregular waves of a first float and a second float.

Figure 10A:
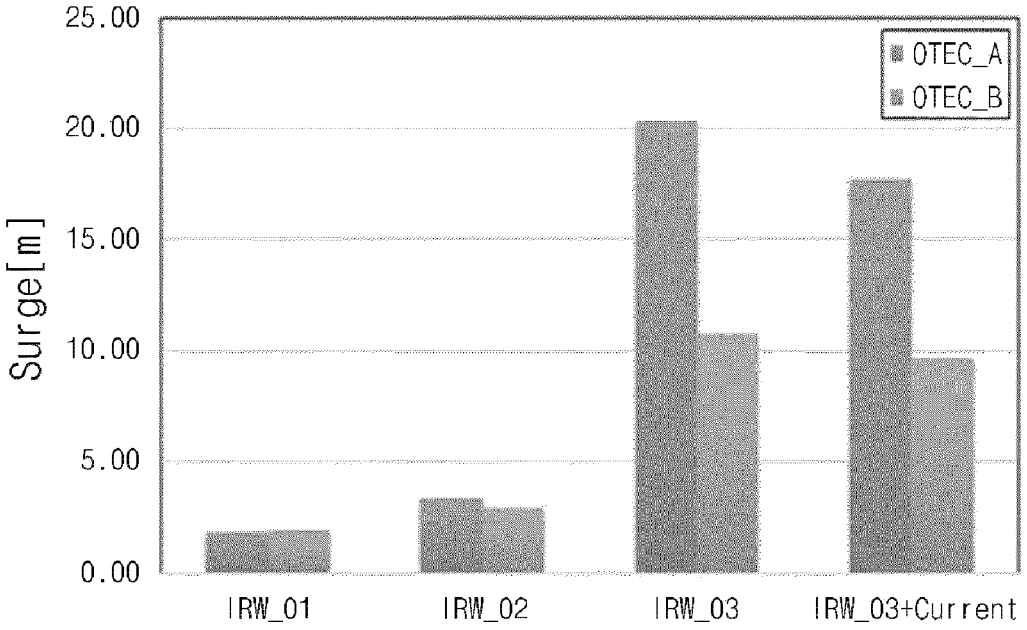
FIGS. 10A to 11C are graphs showing motion response characteristics to irregular waves.
Figure 10B:
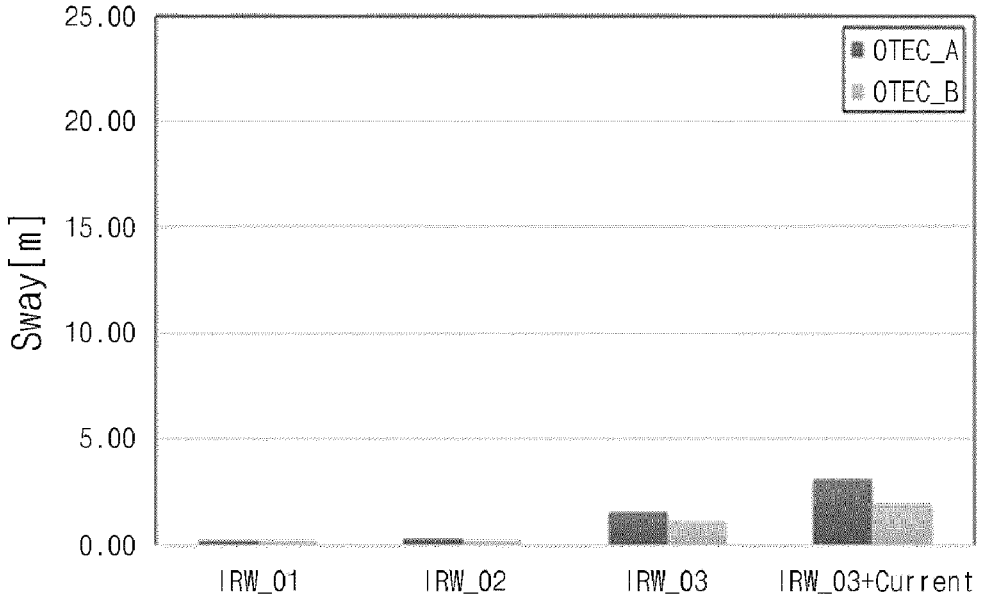
Figure 10C:
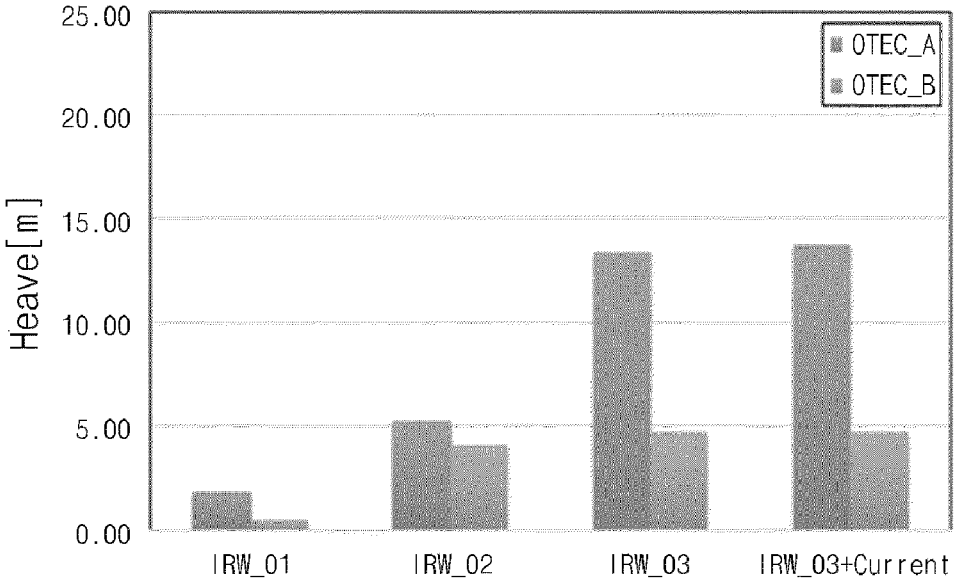
Figure 11A:
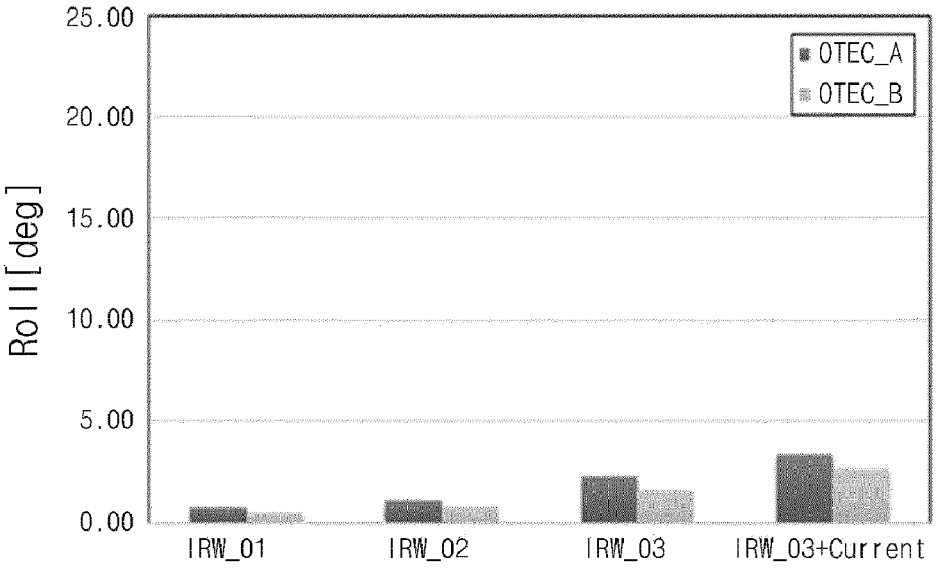
Figure 11B:
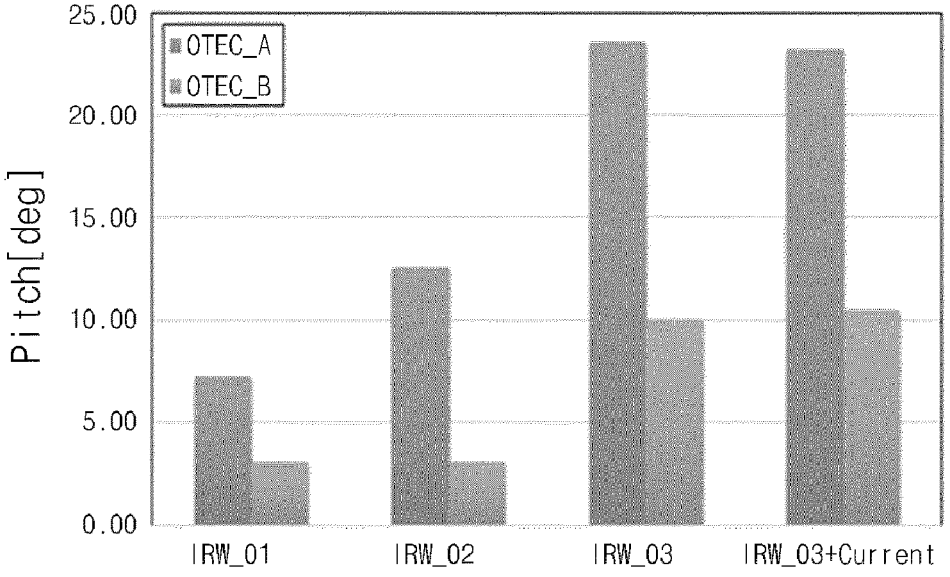
Figure 11C:
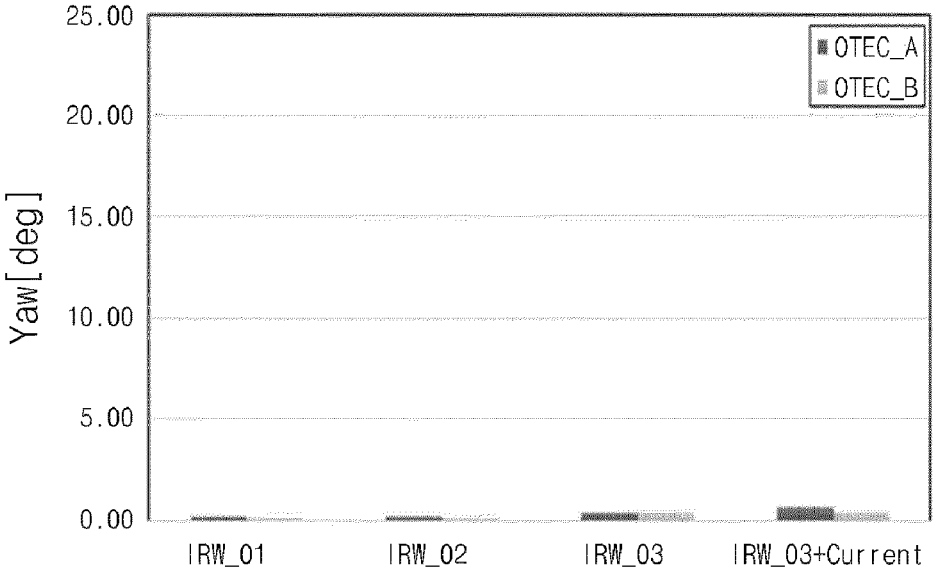
Figure 12A:
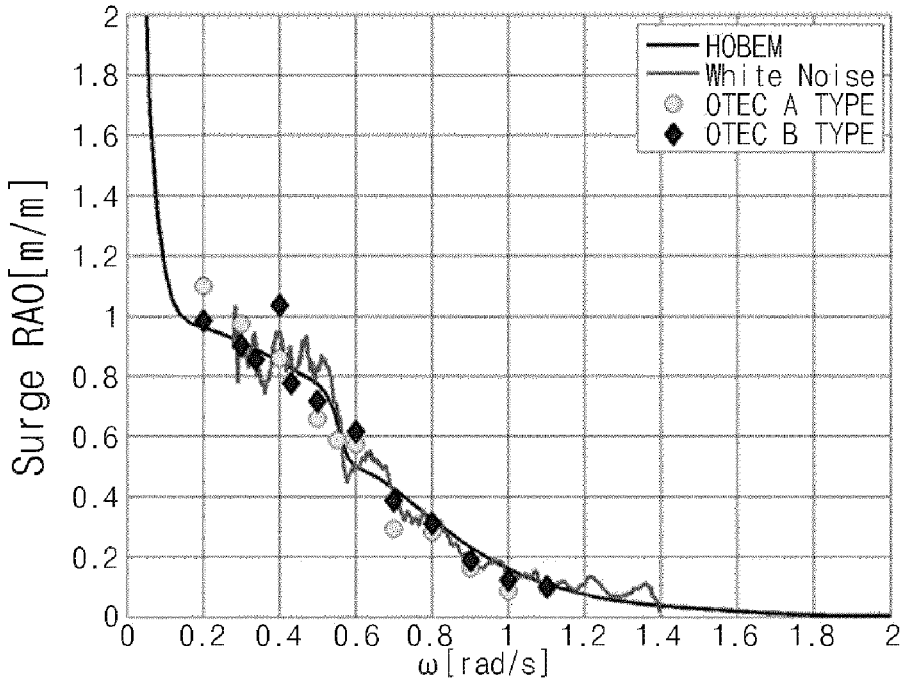
FIGS. 12A to 13C are graphs showing motion response characteristics to regular waves.
Figure 12B:
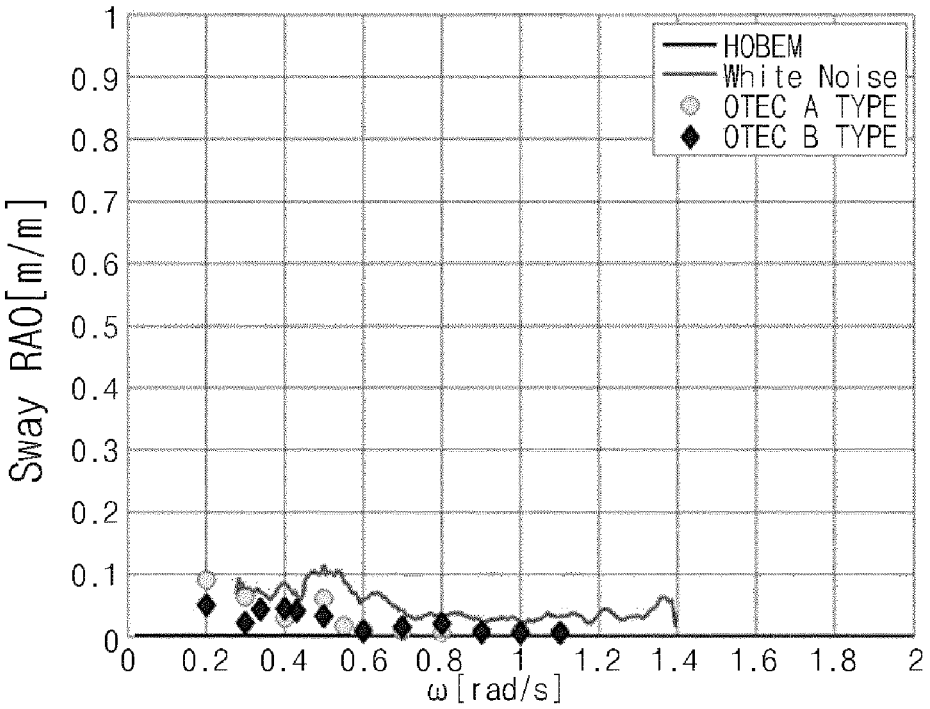
Figure 12C:
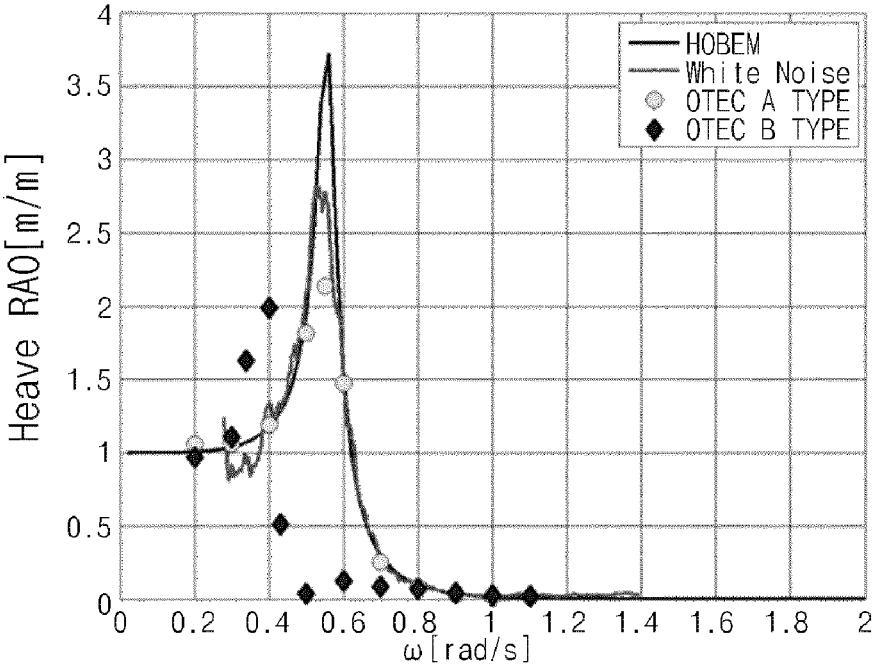
Figure 13A:
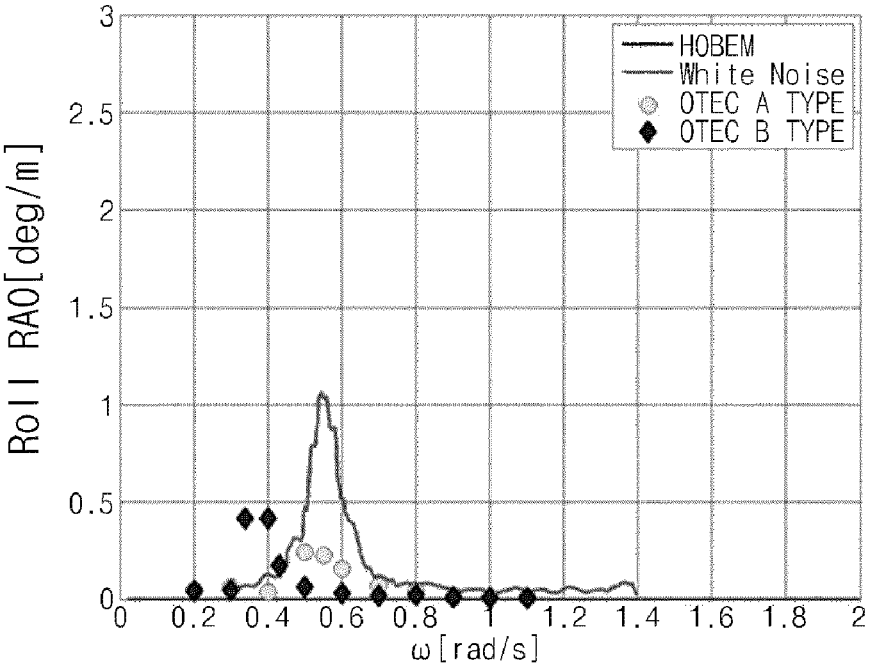
Figure 13B:
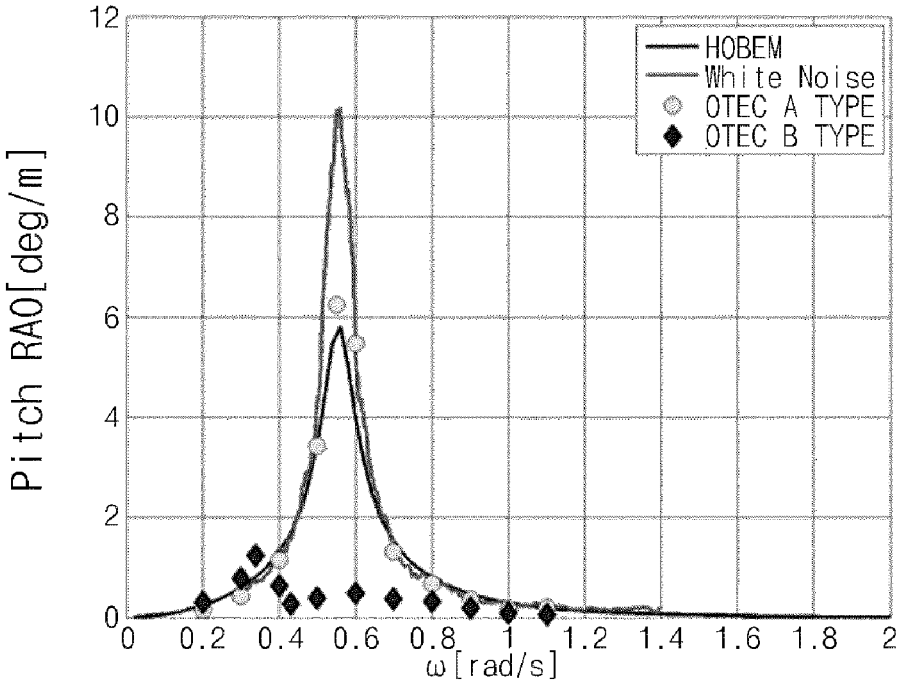
Figure 13C:
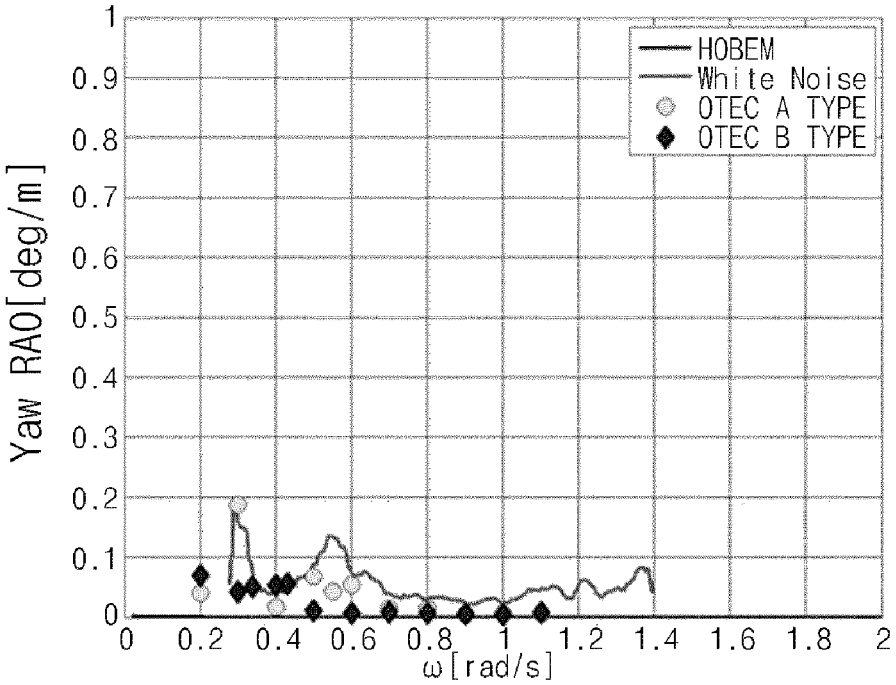

FIGS. 10A to 10C show characteristics of surging, swaying, and heaving of the floats 100 and 200 under irregular waves such that irregular waves or surges can be applied, and FIGS. 11A to 11C show characteristics of roll, pitch, and yaw.

As shown in the figures, it can be seen that movement of the first float 100 is reduced about 30% to 60% in comparison to the second float 200 with respect to a significant value.

FIGS. 12A to 13C are graphs showing motion response characteristics to regular waves, in which it can be seen that the first float 100 moves the resonance frequencies of heaving and pitching to a low frequency range in comparison to the second float 200, so the entire magnitude of movement is reduced.

As described above, a first float according to the present invention is equipped with a damping unit on the bottom of the floating body, so it is possible to reduce movement due to waves or surges.

Although the present invention has been described with reference to the embodiments illustrated in the drawings, those are only examples and may be changed and modified into other equivalent embodiments from the present invention by those skilled in the art. Therefore, the technical protective scope of the present invention should be determined by the scope described in claims.

According to the floating marine structure of the present invention, coupling holes are formed at the sides of the floating body of a first float and second floats are coupled to the first float with regular intervals by coupling protrusions that are inserted and fixed in the coupling holes, so the floats can be easily coupled. Further, a damping unit for reducing movement is coupled to the first float at the center of the floating marine structure, so movement due to waves or surges can be reduced.

Further, according to the present invention, it is possible to achieve a floating marine structure assembly having air shock-absorbing spaces that provide damping effect on the sea, by coupling a plurality of floating marine structures and covering spaces between floats with covers.

The invention claimed is:

1. A floating marine structure comprising:

a first float disposed at a center; and a plurality of second floats disposed around the first float; wherein, the first float has (a) a floating body made of a floatable material in a polygonal prism shape, (b) a damping unit coupled to a bottom of the floating body at a center thereof, the damping unit having the same cross-section shape as the floating body, having a cross-sectional area larger than a cross-sectional area of the floating body, and being effective to reduce movement of the first float in a body of water, and (c) at least one coupling hole formed at each side of the floating body, the second float has the same shape as the floating body and has coupling protrusions formed at sides facing the sides of the floating body and inserted in the coupling holes, the coupling holes are formed at alternate sides of the floating body, the coupling hole has an inlet hole formed inwardly perpendicularly to the side of the floating body and a locking hole extending at a right angle from an end of the inlet hole, the coupling protrusion has a first locking portion protruding outward from the side of the second float and a second locking portion extending at a right angle from an end of the first locking portion, the second locking portion is inserted in the inlet hole and then slid into the locking hole, thereby coupling the first float and the second float to each other, first through-holes are formed from a top of the floating body to the locking holes, second through-holes are formed in the second locking portions, and the first float and the second float are coupled to each other by inserting coupling pins into the first through-holes and the second through-holes with the second locking portions fitted in the locking holes.

2. The floating marine structure of claim 1, further comprising covers disposed in spaces between adjacent second floats.

3. The floating marine structure of claim 1, wherein the floating body has a regular octagonal cross-section.

4. The floating marine structure of claim 1, wherein a height ratio between the floating body and the damping unit is 1.5:1 to 1.6:1.

5. The floating marine structure of claim 1, wherein a length ratio between the cross-section of the floating body and the cross-section of the damping unit is 1:1.5 to 1:1.6.

6. A floating marine structure assembly formed by coupling a plurality of the floating marine structures of claim 1.

7. The floating marine structure assembly of claim 6, wherein covers are disposed in spaces between the first floats and the second floats and air shock-absorbing spaces having damping effect on the sea are defined by covering the spaces with the covers.

* * * * *